US010967643B2

(12) United States Patent
Nanjo et al.

(10) Patent No.: US 10,967,643 B2
(45) Date of Patent: Apr. 6, 2021

(54) LIQUID EJECTING APPARATUS

(71) Applicant: CANON KABUSHIKI KAISHA, Tokyo (JP)

(72) Inventors: Tatsuo Nanjo, Kawasaki (JP); Kenta Udagawa, Tokyo (JP); Hiroshi Koshikawa, Yokohama (JP); Keisuke Iinuma, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/560,830

(22) Filed: Sep. 4, 2019

(65) Prior Publication Data

US 2020/0079094 A1 Mar. 12, 2020

(30) Foreign Application Priority Data

Sep. 10, 2018 (JP) ..... JP2018-168994

(51) Int. Cl.
*B41J 2/175* (2006.01)

(52) U.S. Cl.
CPC ..... *B41J 2/17513* (2013.01); *B41J 2/17509* (2013.01); *B41J 2/17553* (2013.01); *B41J 2/17556* (2013.01)

(58) Field of Classification Search
CPC ..... B41J 2/17513; B41J 2/17566; B41J 2/17556; B41J 2/17553; B41J 2/1752; B41J 2/17509; B41J 29/13
See application file for complete search history.

(56) References Cited

U.S. PATENT DOCUMENTS

| | | | | |
|---|---|---|---|---|
| 6,095,643 | A * | 8/2000 | Cook | B41J 2/17513 347/87 |
| 6,220,688 | B1 | 4/2001 | Ishimatsu et al. | 347/20 |
| 6,502,931 | B2 | 1/2003 | Udagawa et al. | 347/86 |
| 6,540,314 | B1 | 4/2003 | Sanada et al. | 347/7 |
| 6,592,202 | B2 | 7/2003 | Udagawa et al. | 347/40 |
| 6,592,215 | B2 | 7/2003 | Udagawa et al. | 347/93 |
| 6,652,702 | B2 | 11/2003 | Miyazaki et al. | 156/272.2 |

(Continued)

FOREIGN PATENT DOCUMENTS

| | | | |
|---|---|---|---|
| JP | 2007021971 | A * | 2/2007 |
| JP | 2015-112847 | | 6/2015 |

(Continued)

*Primary Examiner* — Sharon Polk
(74) *Attorney, Agent, or Firm* — Venable LLP

(57) ABSTRACT

Provided is a liquid ejecting apparatus comprising: a cartridge capable of ejecting a liquid stored therein; a flow channel through which the cartridge and a liquid tank capable of supplying the liquid to the cartridge are in fluid communication with each other; a closing unit capable of closing the flow channel; and a movable member configured to be operated before the cartridge and the flow channel are uncoupled. The closing unit comprises a closing member, and closes the flow channel with the closing member moved with movement of the movable member. The liquid ejecting apparatus further comprises a carriage capable of carrying the cartridge and moving during liquid ejection of the cartridge. The movable member is a covering member provided to the carriage and configured to cover the cartridge, and in replacement of the cartridge, the movable member is removed from covering the cartridge to allow access to the cartridge.

6 Claims, 9 Drawing Sheets

(56) References Cited

U.S. PATENT DOCUMENTS

| | | | | |
|---|---|---|---|---|
| 6,758,557 | B2 | 7/2004 | Udagawa et al. | 347/86 |
| 6,896,359 | B1 | 5/2005 | Miyazaki et al. | 347/58 |
| 6,910,759 | B2 | 6/2005 | Kawamura et al. | 347/50 |
| 7,533,960 | B2 | 5/2009 | Yasuda et al. | 347/40 |
| 2004/0196339 | A1* | 10/2004 | Kobayashi | B41J 2/17509 347/85 |
| 2015/0165783 | A1 | 6/2015 | Yoshida | B41J 2/17596 |

FOREIGN PATENT DOCUMENTS

| | | |
|---|---|---|
| JP | 2015-147423 | 8/2015 |
| JP | 2017-154252 | 9/2017 |

* cited by examiner

LIQUID EJECTING APPARATUS

BACKGROUND OF THE INVENTION

Field of the Invention

The present invention relates to a liquid ejecting apparatus that ejects a liquid and particularly to a liquid ejecting apparatus that supplies a liquid to a cartridge from a liquid tank and ejects the liquid from an ejecting head provided in the cartridge.

Description of the Related Art

There are liquid ejecting apparatuses in which, as a mechanism to generate a negative pressure inside a cartridge, a liquid tank is provided below the position of an ejecting head in the direction of gravity to generate a negative pressure by means of a water head difference.

Japanese Patent Laid-Open No. 2015-147423 discloses an inkjet printing apparatus that supplies inks to a head unit from ink tanks, in which a valve unit is provided at a point along flow channels for supplying the inks to the head unit, and the ink flow channels are closed by the user's operation of the valve unit.

SUMMARY OF THE INVENTION

A liquid ejecting apparatus of the present invention is a liquid ejecting apparatus comprising: a cartridge capable of ejecting a liquid stored therein; a flow channel through which the cartridge and a liquid tank capable of supplying the liquid to the cartridge are in fluid communication with each other; a closing unit capable of closing the flow channel; and a movable member configured to be operated before the cartridge and the flow channel are uncoupled from each other. The closing unit comprises a closing member, and closes the flow channel with the closing member moved with movement of the movable member. The liquid ejecting apparatus further comprises a carriage capable of carrying the cartridge and moving during liquid ejection of the cartridge. The movable member is a covering member provided to the carriage and configured to cover the cartridge, and in replacement of the cartridge, the movable member is removed from covering the cartridge by a user to allow access to the cartridge.

Further features of the present invention will become apparent from the following description of exemplary embodiments with reference to the attached drawings.

DESCRIPTION OF THE EMBODIMENTS

In cartridge replacement, the valve unit described in Japanese Patent Laid-Open No. 2015-147423 can be used to close a tube serving as a flow channel. This makes it possible to prevent the liquid inside the tube from returning into the liquid tank due to the water head difference when the cartridge is detached.

However, in case where the user forgets to operate the valve unit, the liquid inside the tube returns into the liquid tank due to the water head difference. In this case, after a new cartridge is mounted, it is necessary to discharge the liquid inside the ejecting head by ejection or suction and then fill the tube with liquid by suction. Accordingly, it takes a significant amount of time before the liquid ejecting apparatus becomes capable of performing an ejection operation, which may possibly decrease the operation rate. A large amount of liquid is wasted as well.

In view of this, the present invention provides a liquid ejecting apparatus capable of preventing decrease in operation rate and preventing wasting of liquid.

First Embodiment

A first embodiment of the present invention will be described below with reference to drawings.

Figure 1:
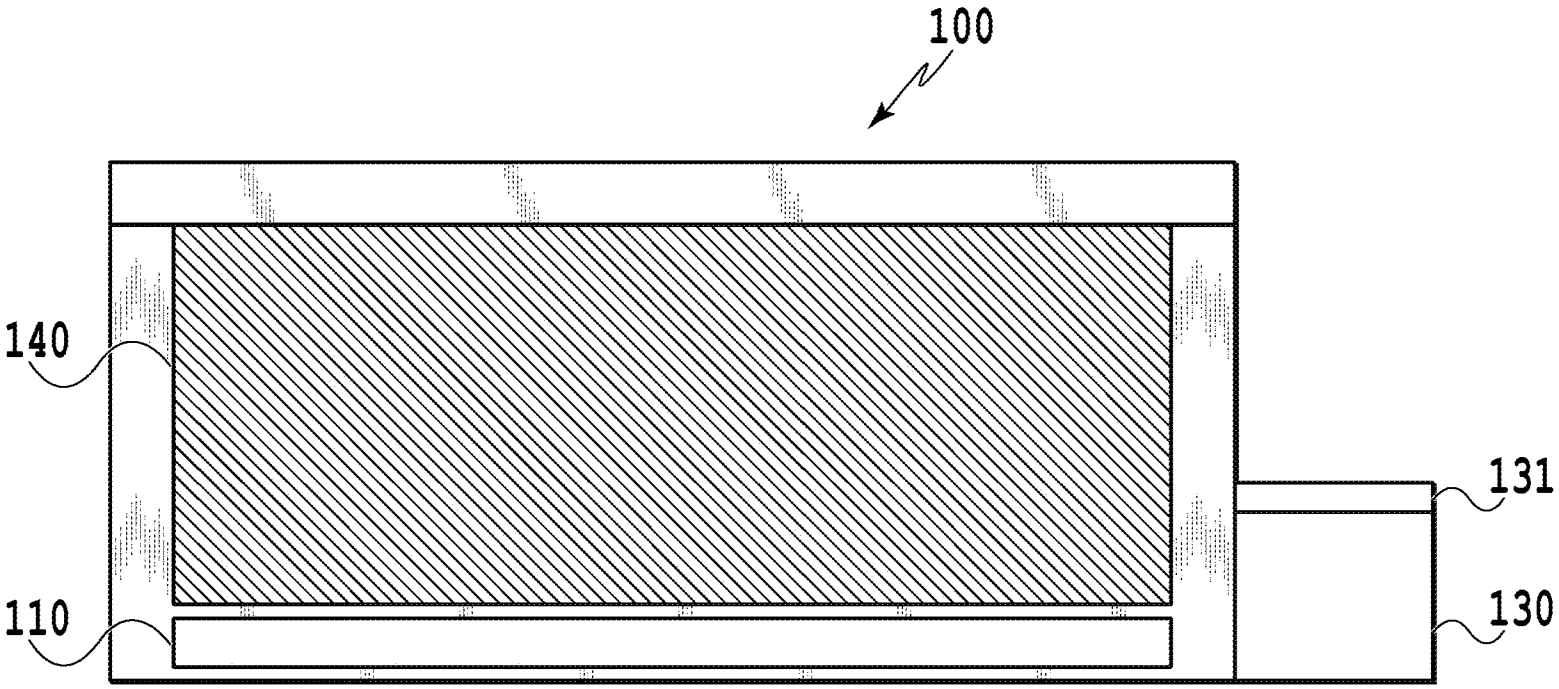
FIG. 1 is a schematic front view showing a liquid ejecting apparatus.

FIG. 1 is a schematic front view showing a liquid ejecting apparatus 100 to which the present invention is applicable. The liquid ejecting apparatus 100 is capable of forming (hereinafter also expressed as "printing") an image on a medium by ejecting liquid (hereinafter also referred to as "ink") onto the medium from a cartridge. On the front side of the liquid ejecting apparatus 100, a front cover (movable member) 140 is provided which movable by the user. For replacement of a cartridge 200 or in case of a paper jam, the user can open the front cover 140 to replace the cartridge or handle the paper jam. The medium with the image formed thereon is discharged from a discharging unit 110.

Figure 2:
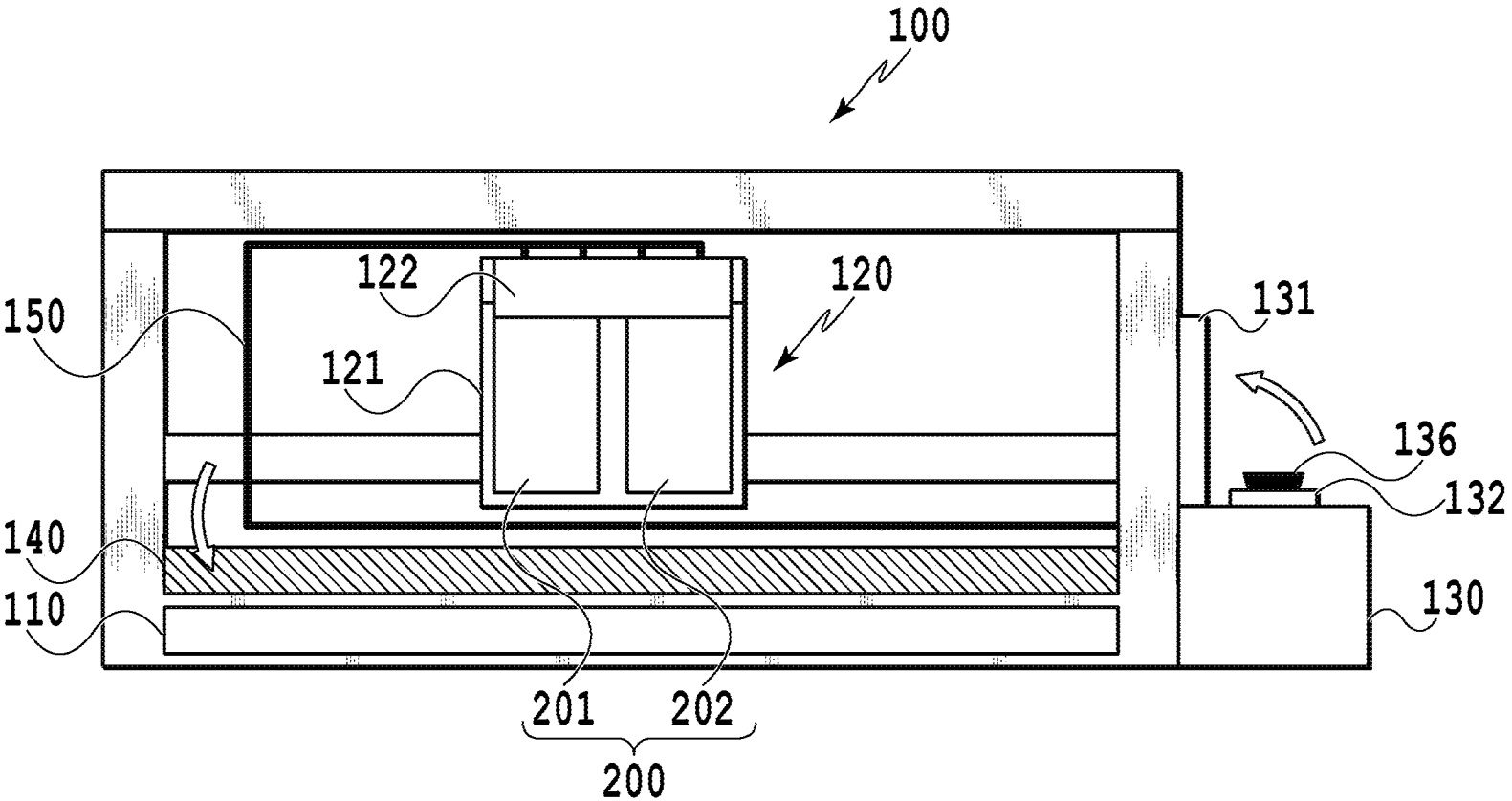
FIG. 2 is a front view of the liquid ejecting apparatus with its front cover and ink tank cover opened.

FIG. 2 is a schematic front view showing the liquid ejecting apparatus 100 with the front cover (cover member) 140 and an ink tank cover 131 opened. The liquid ejecting apparatus 100 comprises a printing unit 120. The printing unit 120 is capable of carrying the cartridge 200 on a carriage 121 capable of reciprocally moving in a main scanning direction. The carriage 121 with the cartridge 200 mounted thereon moves the cartridge 200 in the main scanning direction during printing (during liquid ejection).

The front cover 140 forms a part of the casing of the liquid ejecting apparatus 100. The user can open the front cover 140 to access the printing unit 120. The carriage 121 is provided with a carriage cover 122 that covers the cartridge 200. The cartridge 200 is capable of ejecting inks, and ejects inks stored inside the cartridge 200. Ink tanks 132 are capable of supplying the inks to the cartridge 200. The inks to be used for printing are filled in the ink tanks 132 inside an ink tank unit 130.

The cartridge 200 receives the amount of ink it consumed from the corresponding ink tank (liquid tank) 132 through a tube 150 made of a flexible material. Two cartridges, namely, a black cartridge 201 and a color cartridge 202 for three colors of cyan, magenta, and yellow, are mounted in the cartridge 200. In a case where the amount of ink in any of the ink tanks 132 is low, the ink is replenished by opening the ink tank cover 131, taking off a rubber stopper 136, and directly filling ink into the ink tank 132.

The front cover 140 functions as an operable part, and a valve to be described later (closing member) opens and closes the flow channel in each tube 150 in conjunction with movement of the front cover 140. The front cover 140 is opened by pulling it toward the near side. The ink tank cover 131 is opened by pivotally moving it counterclockwise.

Figure 3:
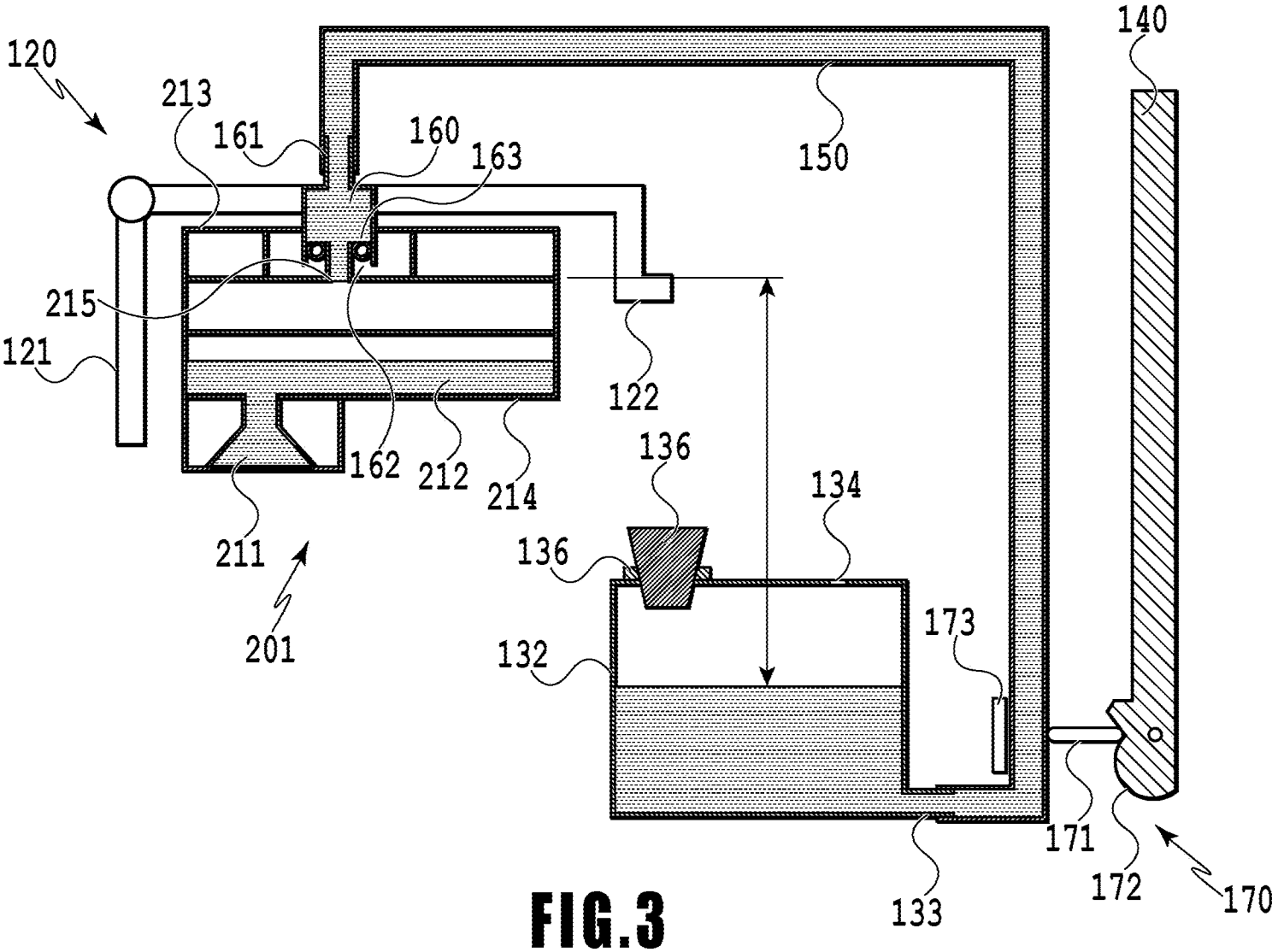
FIG. 3 is a schematic diagram showing an ink supply system of the liquid ejecting apparatus with the front cover closed.

FIG. 3 is a schematic diagram showing an ink supply system of the liquid ejecting apparatus 100 with the front cover 140 closed. The state shown in FIG. 3 is the state of the liquid ejecting apparatus 100 for performing a normal printing operation (including being in standby for printing). A description will be given here by taking the black cartridge 201 as an example, but the configuration is also the same for the color cartridge 202. The cartridge 201 comprises an ejecting head 211 that ejects ink at the lowermost part in the direction of gravity of the cartridge 201 in the posture for use. The cartridge 201 also comprises an absorbing body 212 therein that absorbs ink, and holds ink with this absorbing body 212. The absorbing body 212 prevents leakage of the ink from the ejecting head 211 before the cartridge 201 is mounted in the liquid ejecting apparatus 100.

A lid member 213 is provided at the top of the cartridge 201. The lid member 213 and a tank case 214 are welded to each other to define the inside of the cartridge 201. Also, an ink introducing port 215 is provided in this lid member 213. The ink introducing port 215 extends in a tubular shape from slightly below a position where the lid member 123 is coupled to a joint member 160 provided at an end of the tube 150. As the ink inside the ejecting head 211 is consumed with the ink introducing port 215 and the joint member 160 coupled to each other, ink is filled into the cartridge 201 from the ink tank 132 through the tube 150 and the joint member 160.

The ink tank 132 has an internal space capable of storing ink. At a lower portion of the ink tank 132, an ink outlet port 133 is provided which serves as a portion communicating with an external component. The ink outlet port 133 is coupled to the tube 150 by press fitting, so that the ink inside the ink tank 132 flows out from the ink outlet port 133 into the tube 150. Also, in an upper portion of the ink tank 132, an air communication port 134 is provided through which to take in an amount of air corresponding to the amount of ink reduced inside the ink tank 132. The size of the air communication port 134 is set to be small in order to prevent leakage and evaporation of the ink. Additionally, a maze, a small chamber, a gas-liquid separation membrane, or the like may be provided at an end of the air communication port 134.

Further, an ink filling port 135 is provided in the upper portion of the ink tank 132. Ink in an ink bottle or the like is filled into the ink tank 132 from the ink filling port 135 after the liquid ejecting apparatus 100 is delivered or in a case where the remaining amount of ink is low. Also, the ink filling port 135 is provided as a larger opening than the air communication port 134 so that the tip nozzle of an ink bottle or the like can be inserted in the ink filling port 135. At times other than ink filling, the ink filling port 135 is sealed with the rubber stopper 136 in order to prevent leakage and evaporation of the ink.

The tube 150 is coupled at one end to the ink tank 132 and coupled at the other end to the cartridge 201 through the joint member 160 to thereby form an ink channel from the ink tank 132 to the cartridge 201. In other words, the ink tank 132 and the cartridge 201 are in fluid communication with each other through the tube 150. The tube 150 is required to be able to follow the scanning movement of the carriage 121 and to be closed by a valve 170 to be described later. For this reason, a flexible material is employed as its material. Also, the tube 150 is required to have air barrier properties and water vapor barrier properties. For this reason, a styrene-based elastomer is employed in the present embodiment.

The joint member 160 is a coupling member that couples the cartridge 201 and the tube 150, and has an ink port 161 to be coupled to the tube 150 and a joint port 162 to be coupled to the cartridge 201. The ink port 161 is coupled to the tube 150 by press fitting. The joint port 162 has a rubber member 163 in its opening portion and is coupled to the ink introducing port 215 while maintaining a sealed state therebetween with sealing by the rubber member 163. The joint member 160 is attached to the carriage cover (covering member) 122 of the carriage 121, and the cartridge 201 and the joint port 162 get coupled to each other in synchronization with pivotal movement of the carriage cover 122. Specifically, the joint port 162 of the joint member 160 is separated from the cartridge 201 in the state where the carriage cover 122 is opened, and the joint port 162 and the ink introducing port 215 are coupled to each other in the state where the carriage cover 122 is closed.

The valve 170 is provided to be capable of closing a part of the tube 150 between the ink tank 132 and the cartridge 201, and includes a valve element 171, a pressing portion (pressing member) 172, and a holding portion 173. The pressing portion 172 is provided as a part of the front cover 140 and is capable of pressing the valve element 171 in conjunction with an opening operation of the front cover 140 to thereby close a part of the tube 150.

Figure 4:
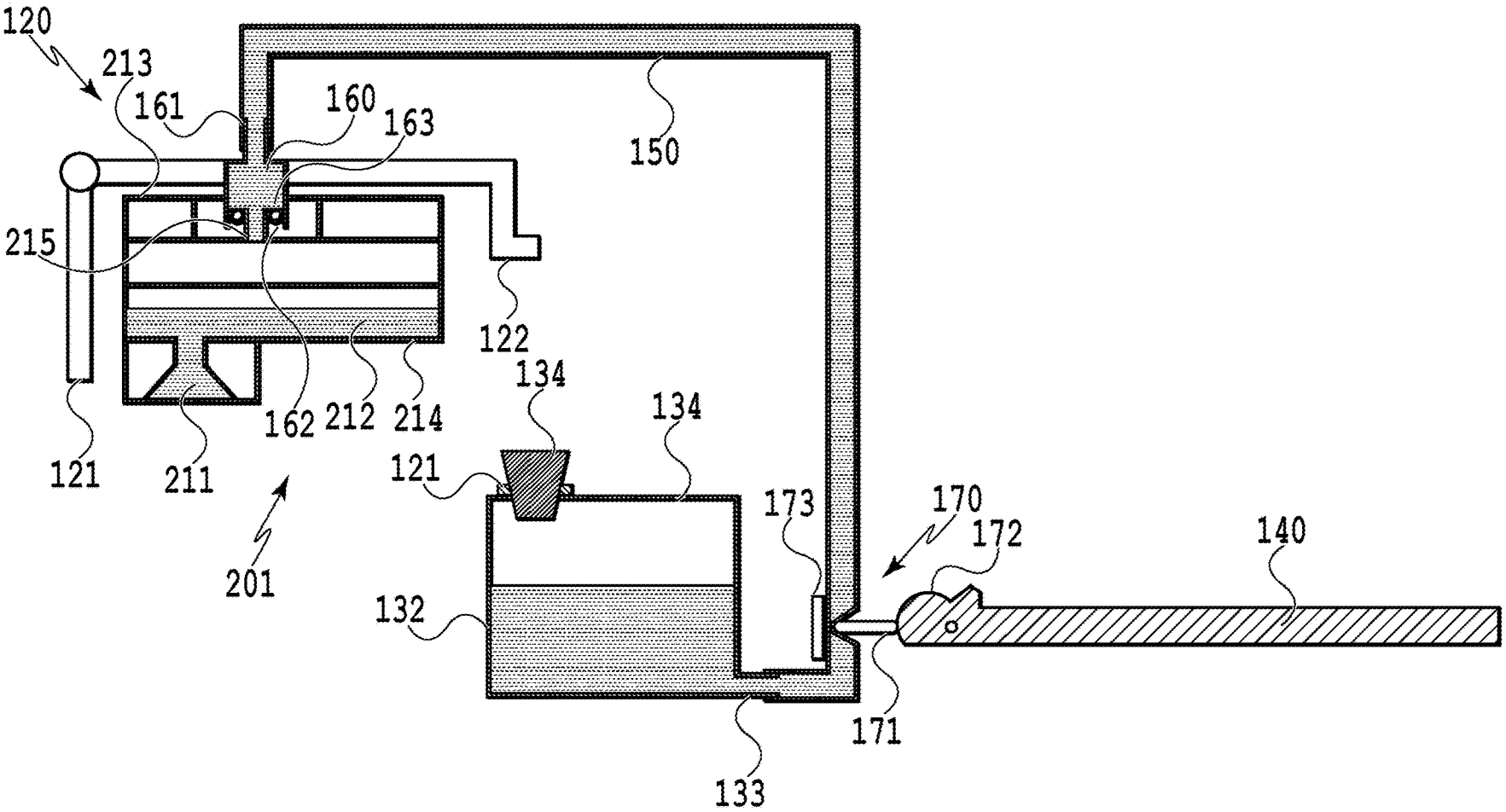
FIG. 4 is a schematic diagram showing the ink supply system of the liquid ejecting apparatus with the front cover opened.

FIG. 4 is a schematic diagram showing the ink supply system of the liquid ejecting apparatus 100 with the front cover 140 opened. The pressing portion 172 is formed in a cam shape and the cam of the pressing portion 172 moves the valve element 171 by pivotally moving with opening and closing operations of the front cover 140. The pressing portion 172 does not press the valve element 171 in the case where the front cover 140 is closed (see FIG. 3). The pressing portion 172 presses the valve element 171 in the case where the front cover 140 is opened (see FIG. 4). The pressed valve element 171 moves the tube 150 in a closing direction, so that the valve element 171 and the holding portion 173, located on the opposite side of the tube 150 from the valve element 171, pinch the tube 150 to thereby close the tube 150.

Next, a method of supplying ink in the liquid ejecting apparatus 100 will be described. As shown in FIG. 3, the liquid ejecting apparatus 100 is configured such that the liquid surface of the ink inside the ink tank 132 is located below the ejecting head 211 in the direction of gravity. In this state, the ink inside the tube 150 attempts to return toward the ink tank 132 due to the presence of a water head difference. Accordingly, a negative pressure corresponding to the water head difference across the height of the arrowed line in FIG. 3 is generated in the cartridge 201. This negative pressure by the water head difference and the capillary force in the absorbing body 212 prevents ink leakage from the ejecting head 211.

As ink is ejected from the ejecting head 211, the amount of ink in the cartridge 200 decreases accordingly. As the amount of ink decreases, the negative pressure in the cartridge 200 further rises. As a result, the amount of ink consumed is supplied into the cartridge 201 from the ink introducing port 215, thereby reducing the negative pressure. This series of events is repeated to supply ink to the cartridge 201.

A characteristic configuration of the present invention will be described below.

Figure 5:
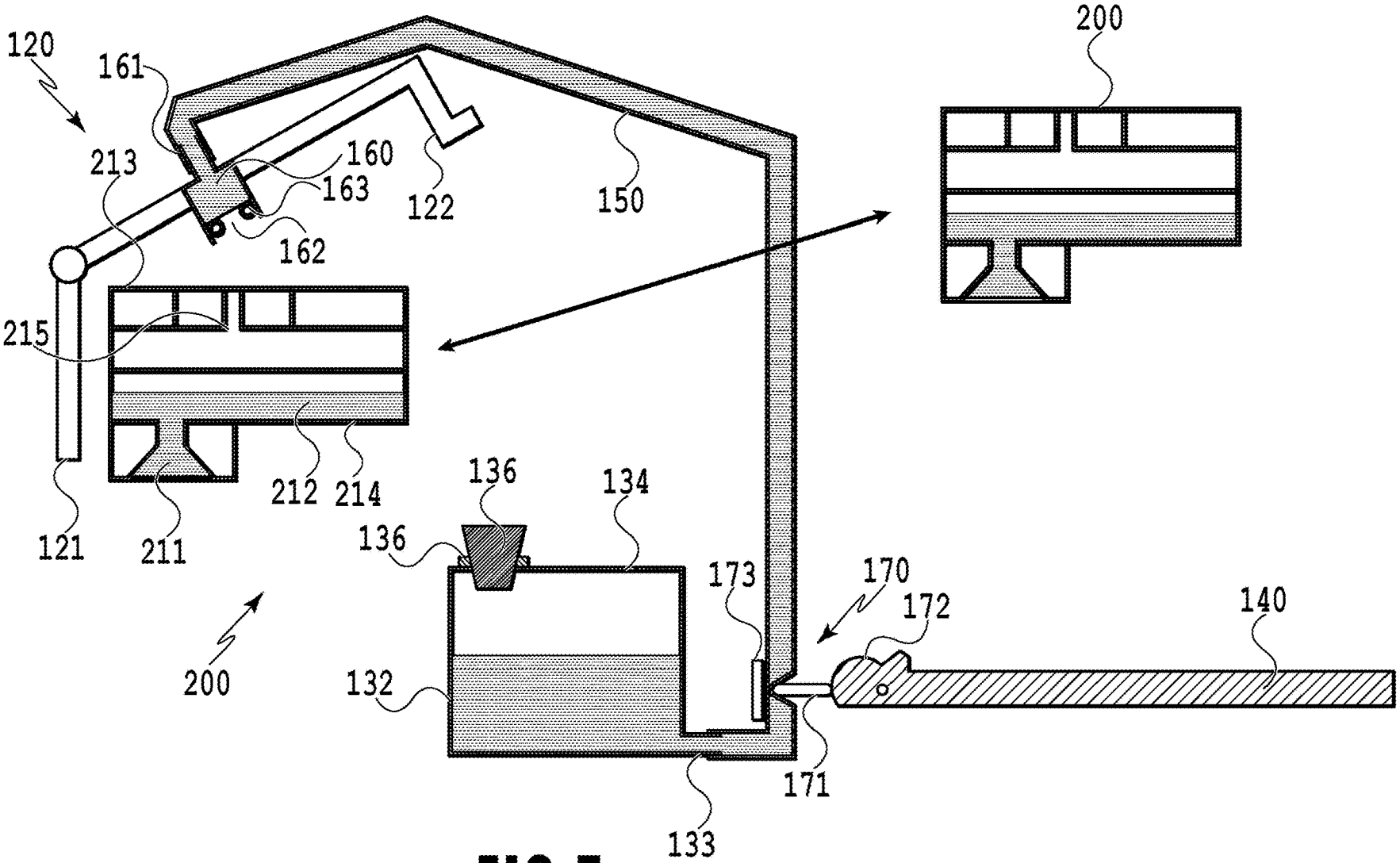
FIG. 5 is a diagram showing the ink supply system of the liquid ejecting apparatus with its carriage cover opened.

FIG. 5 is a schematic diagram showing the ink supply system of the liquid ejecting apparatus 100 with the front cover 140 and the carriage cover 122 opened. Replacement of the cartridge starts from the state shown in FIG. 3, which is a printing standby state. To replace the cartridge, the user firstly opens the front cover 140 so that the user can access the cartridge 201, which is the target of the operation. As shown in FIG. 4, as the front cover 140 is opened, the valve element 171 is pressed and moved by the cam of the pressing portion 172 in conjunction with the opening operation of the front cover 140, thereby closing the tube 150. In other words, opening the front cover 140 closes the tube 150 regardless of whether the user intends to or not. Note that this valve element 171 is not necessarily essential. The pressing portion 172 may be configured to directly press the tube 150 to close it.

Then, as shown in FIG. 5, the user opens the carriage cover 122. As the carriage cover 122 is opened, the joint member 160, attached to the carriage cover 122, is also pivotally moved along with the carriage cover 122 and uncoupled from the cartridge 201. In a conventional configuration, with the joint member 160 and the cartridge 201 uncoupled from each other, the ink in the joint member 160 and the tube 150 moves as result of receiving a force in the flow direction toward the ink tank 132 generated by the water head difference. In the present embodiment, however, the ink in the joint member 160 and the tube 150 does not move but maintains the same state since the valve 170 is closing the tube 150. The user replaces the cartridge 201 in this state.

As the user replaces the cartridge 201 with a new cartridge and closes the carriage cover 122, the joint member 160, attached to the carriage cover 122, gets coupled to the cartridge 201. After replacing the cartridge 201, the user closes the front cover 140. Here, the valve element 171, pressing the tube 150, is removed from pressing the tube 150 as the front cover 140 is pivotally moved. As a result, the valve 170 is removed from closing the tube 150. Closing the front cover 140 completes the work of replacing the cartridge 201. In the case where the cartridge 201 is replaced according to the present embodiment, an ejection operation can be performed immediately after the replacement work.

Figure 6:
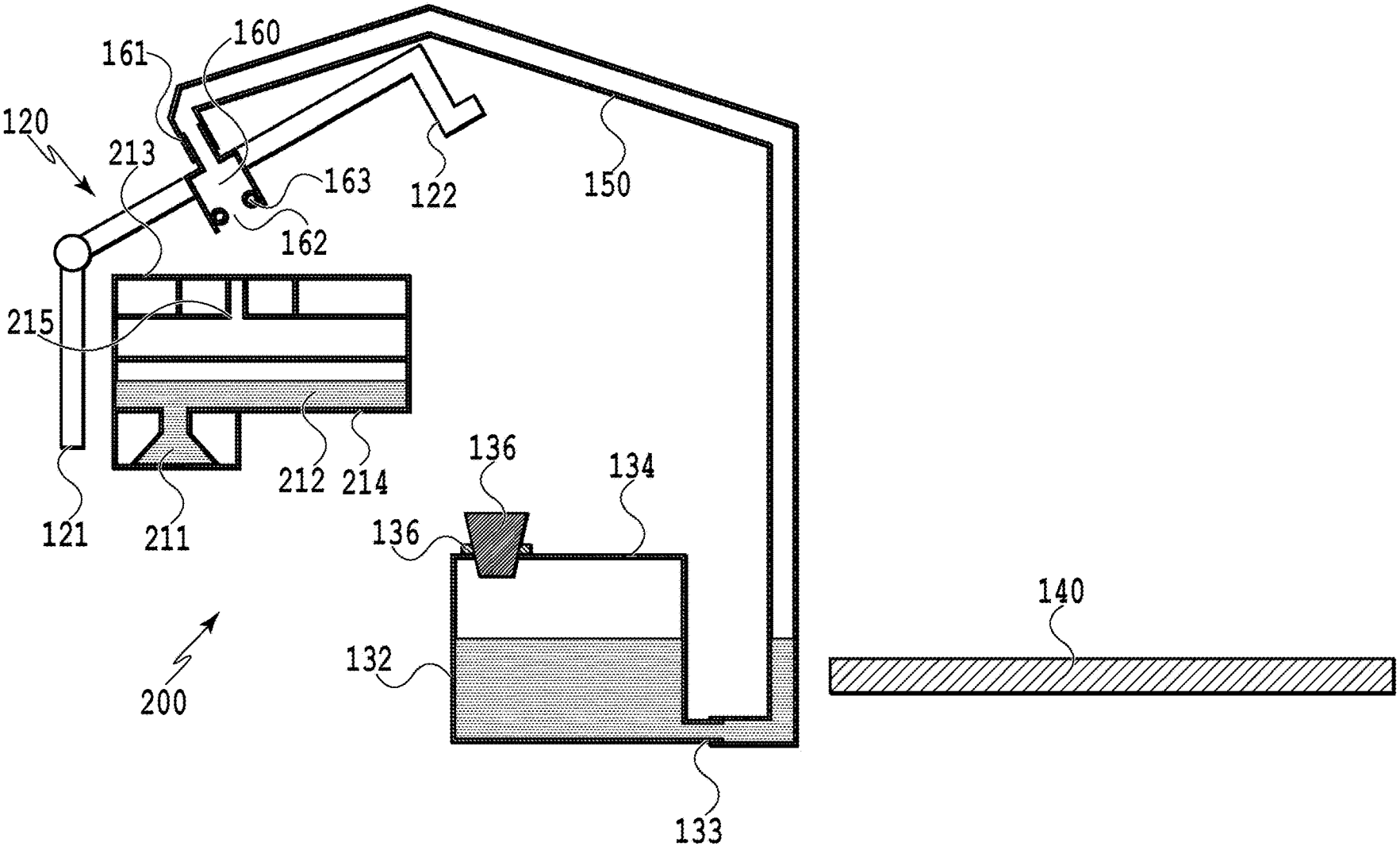
FIG. 6 is a diagram showing an ink supply system of a conventional liquid ejecting apparatus.
Figure 7:
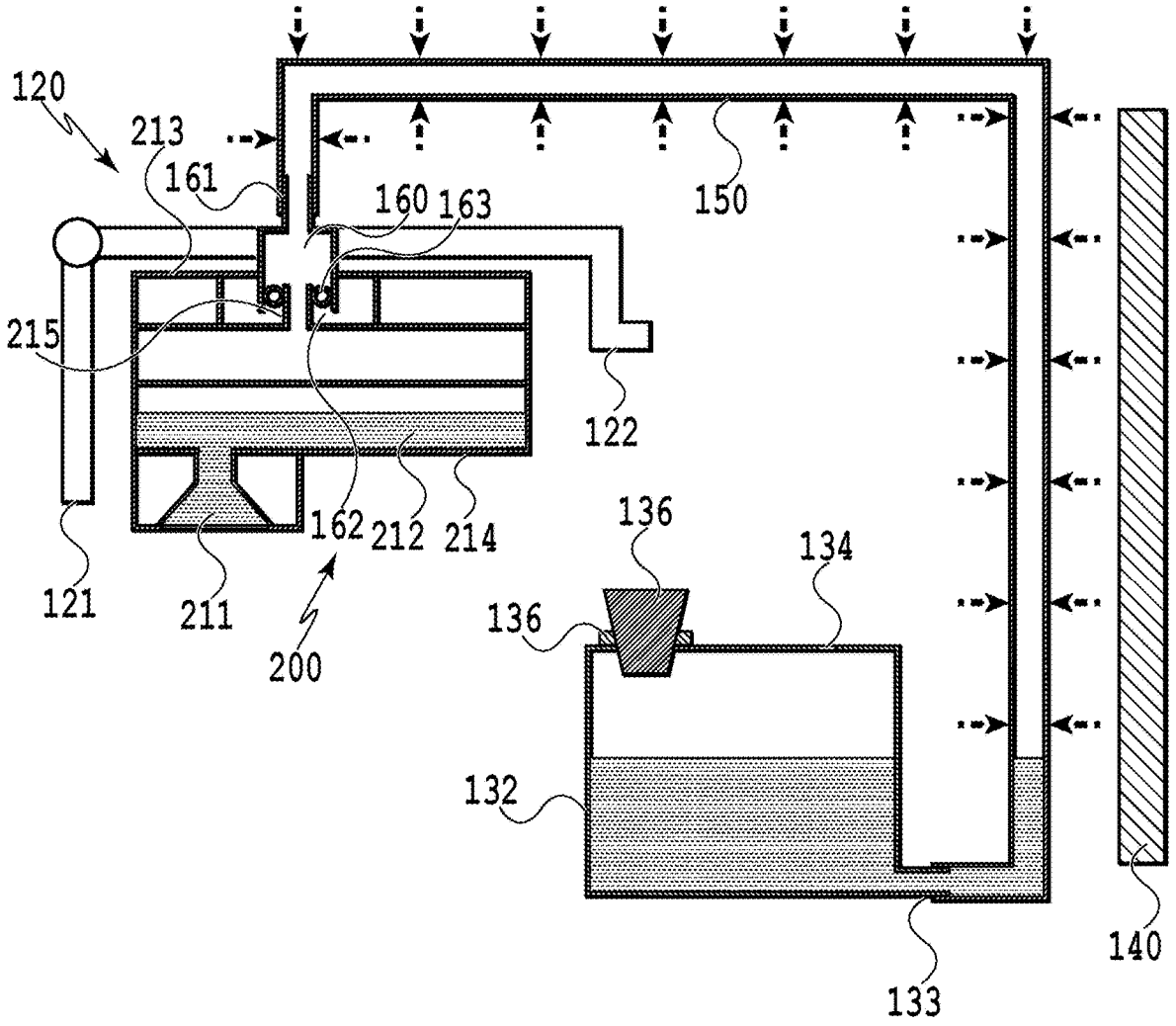
FIG. 7 is a diagram showing the ink supply system of the conventional liquid ejecting apparatus.

FIG. 6 is a diagram showing an ink supply system of a liquid ejecting apparatus with a conventional configuration with its front cover 140 and carriage cover 122 opened. FIG. 7 is a diagram showing the ink supply system with the front cover 140 and the carriage cover 122 closed. Here, replacement of the cartridge with the conventional configuration will be described using FIGS. 6 and 7. Note that no valve is shown in FIGS. 6 and 7 since the description will be given of a case where the user forgot to perform a valve opening/closing operation.

As shown in FIG. 6, the user opens the front cover 140 and then opens the carriage cover 122, thereby uncoupling the joint member 160 and the cartridge 201 from each other. With the conventional configuration, the ink in the tube 150 and the joint member 160 is drawn into the ink tank 132 by the water head difference since the tube 150 is not closed. If, in this state, the user replaces the cartridge 201 with a new cartridge and closes the carriage cover 122, thereby coupling the cartridge and the joint member to each other, they are coupled with air inside the joint member and the tube (see FIG. 7). In a case where an ejection operation is performed with air inside the channel between the cartridge and the ink tank as above, the ink inside the cartridge 201 is consumed but ink will not be filled into the cartridge 201 until ink inside the tube 150 reaches the cartridge. For this reason, if printing is continued, the ink inside the cartridge 201 may possibly be gone and an ejection failure may possibly occur.

Also, in a case where the liquid ejecting apparatus is let stand in the state of FIG. 7 for a long period, the ambient air comes into the tube 150 toward the air therein due to the osmotic pressure between the ambient air and the humid air inside the tube 150, as shown by the arrows in FIG. 7. As the ambient air comes in as above, the ink inside the tube 150 is pushed and moved toward the ink tank 132. Repeating ejection and long-term disuse in this order, for example, leads to a state where the ink inside the cartridge 201 is ejected and thereby consumed but the air coming in due to the osmotic pressure makes it harder for ink to be filled into the cartridge 201. In this case, an ejection failure may possibly occur even if the initial amount of ink inside the cartridge 201 is sufficiently large.

To recover from such a state, it is necessary to perform a sucking operation from the ejecting head 211 side with a pump to fill ink into the cartridge 201, which takes a long time. The recovery also needs an ejection operation, which may possibly increase the amount of ink wasted.

In contrast, in the present embodiment, the liquid ejecting apparatus 100 comprises the valve 170, which is capable of closing the tube 150, and the valve 170 presses and releases the tube 150 in conjunction with opening and closing operations of the front cover 140, which configured to be opened for replacement of the cartridge 201. Thus, the user does not need to keep the operation of the valve 170 in mind, and an opening/closing operation of the valve 170 is automatically performed before the cartridge 201 and the tube 150 are disconnected from each other. Hence, the cartridge is replaced after the tube 150 is securely closed. In this way, printing can be performed immediately after the cartridge replacement and ink is not wasted either.

Note that the valve 170 closes the tube 150 with an operation of opening the front cover 140 in the present embodiment, but the present embodiment is not limited to this case. The configuration only needs to be such that the valve 170 closes the tube 150 with an operation of a member performed before the cartridge 201 are the tube 150 are uncoupled from each other.

Second Embodiment

A second embodiment of the present invention will be described below with reference to drawings. Note that the basic configuration of the present embodiment is similar to that of the first embodiment, and only a characteristic configuration will therefore be described below.

Figure 8:
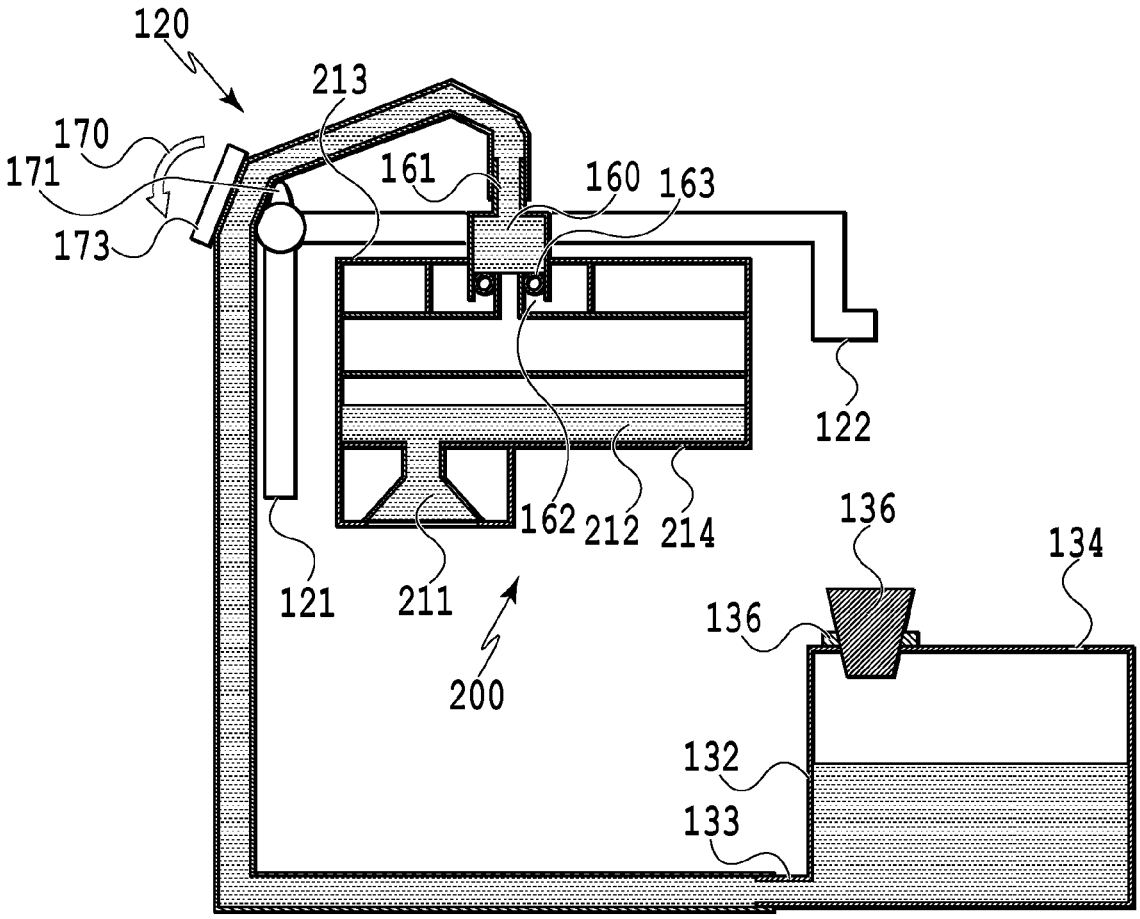
FIG. 8 is a diagram showing an ink supply system of a liquid ejecting apparatus with its carriage cover closed.
Figure 9:
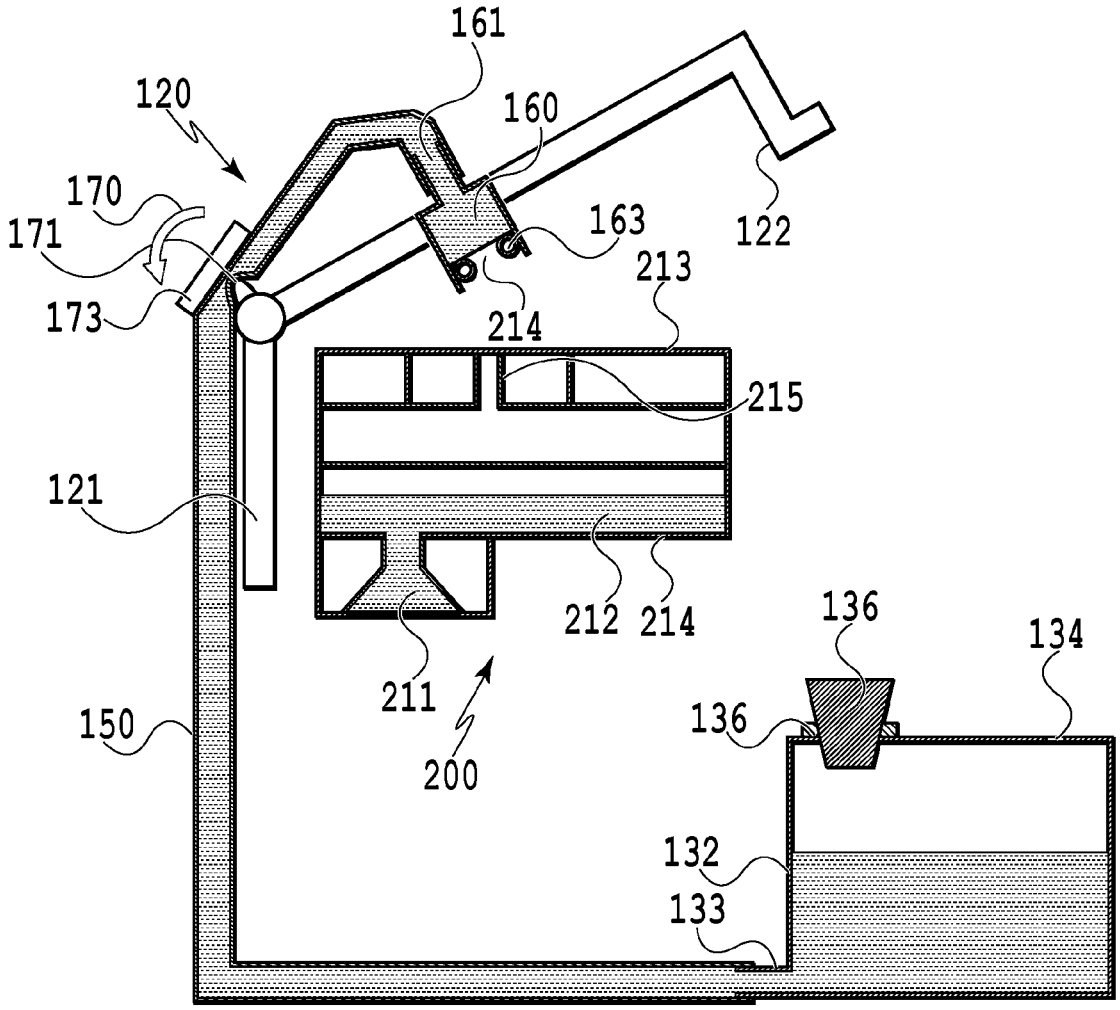
FIG. 9 is a diagram showing the ink supply system of the liquid ejecting apparatus with the carriage cover opened.

FIG. 8 is a diagram showing an ink supply system of a liquid ejecting apparatus in the present embodiment with its carriage cover closed. FIG. 9 is a diagram showing the ink supply system of the liquid ejecting apparatus with the carriage cover opened. In the present embodiment, a valve 170 is configured as a closing unit to close and release a tube 150 in conjunction with opening and closing operations of a carriage cover 122. The valve 170 comprises a valve element 171 and a holding portion 173, and the tube 150 is disposed between the valve element 171 and the holding portion 173. The valve element 171 is provided to pivotally move about the rotational center of the carriage cover 122. As the valve element 171 pivotally moves with an opening operation of the carriage cover 122, the valve element 171 and the holding portion 173 pinch and close the tube 150. Here, the valve 170 is designed such that a cartridge 201 and a joint member 160 are uncoupled from each other after the tube 150 is closed by the valve 170.

The valve 170 closes the tube 150 by squeezing the tube 150 in the direction of the arrow, so that the amount of ink at the squeezed portion moves toward the ink tank 132. Since the amount of ink at the squeezed portion is prevented from moving toward the joint member 160 as described above, it is possible to lower the possibility that ink drips from a joint port 162 and contaminates the cartridge 201 after the uncoupling.

With this configuration too, the tube 150 is closed in a series of operations for cartridge replacement regardless of whether the user intends to or not. Hence, the ink in the joint member 160 and the tube 150 is not drawn into the ink tank by the water head difference even with the cartridge 201 and the joint member 160 uncoupled from each other. Since the cartridge 201 is replaced after the tube 150 is securely closed by the valve 170, a printing operation can be performed immediately after the cartridge replacement and ink is not wasted either.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-168994 filed Sep. 10, 2018, which is hereby incorporated by reference herein in its entirety.

What is claimed is:

1. A liquid ejecting apparatus comprising:

a cartridge capable of ejecting a liquid stored therein;

a flow channel through which the cartridge and a liquid tank capable of supplying the liquid to the cartridge are in fluid communication with each other;

a closing unit capable of closing the flow channel; and a movable member configured to be operated before the cartridge and the flow channel are uncoupled from each other, wherein the closing unit comprises a closing member, and closes the flow channel with the closing member moved with movement of the movable member, the liquid ejecting apparatus further comprises a carriage capable of carrying the cartridge and moving during liquid ejection of the cartridge, the movable member is a covering member provided to the carriage and configured to cover the cartridge, and in replacement of the cartridge, the movable member is removed from covering the cartridge by being moved pivotally by a user to allow access to the cartridge, and the closing member closes the flow channel by being moved pivotally about a rotational center of the covering member, wherein the cartridge and the flow channel are coupled to each other by a joint member included in the covering member, and in replacement of the cartridge, the cartridge and the flow channel are uncoupled from each other by removing the covering member from covering the cartridge.

2. The liquid ejecting apparatus according to claim 1, wherein the flow channel is a tube made of a flexible member.

3. The liquid ejecting apparatus according to claim 2, wherein the closing member is a pressing member configured to press the tube from outside.

4. The liquid ejecting apparatus according to claim 2, wherein the closing unit is comprised of a valve having the closing member and a holding portion, and wherein the closing member is a valve element configured to pinch the tube against the holding member from outside.

5. The liquid ejecting apparatus according to claim 1, wherein the cartridge ejects the liquid from an ejecting head, and the liquid ejecting apparatus is configured such that a liquid surface inside the liquid tank is at a position lower than a liquid surface in the ejecting head.

6. The liquid ejecting apparatus according to claim 1, wherein the cartridge and the joint member are uncoupled from each other after the flow channel is closed by movement of the closing member.

* * * * *